United States Patent [19]

Ritchie, Jr. et al.

[11] Patent Number: 4,506,396

[45] Date of Patent: Mar. 26, 1985

[54] COMFORT PILLOW FOR PREGNANT FEMALES

[75] Inventors: William B. Ritchie, Jr.; Marguerite M. Ritchie, both of Richmond, Va.

[73] Assignee: The Ritchie Family Company, Richmond, Va.

[21] Appl. No.: 480,943

[22] Filed: Mar. 29, 1983

[51] Int. Cl.[3] ..... A47G 9/00

[52] U.S. Cl. ..... 5/431; 5/437

[58] Field of Search ..... 5/431, 437, 436, 434, 5/465, 441, 442, 462, 464

[56] References Cited

U.S. PATENT DOCUMENTS

| | | | |
|---|---|---|---|
| 428,819 | 5/1890 | Stace . | |
| 716,752 | 12/1902 | Phillips . | |
| 941,043 | 11/1909 | Powell . | |
| 2,618,790 | 11/1952 | Ritchey | 5/442 |
| 2,765,480 | 10/1956 | Mueller | 5/436 |
| 2,952,856 | 9/1960 | Ruff | 5/437 |
| 3,118,152 | 1/1964 | Talley, Jr. . | |
| 3,763,509 | 10/1973 | Mittendorf . | |
| 3,775,785 | 12/1973 | Mittendorf | 5/465 |
| 4,345,345 | 8/1982 | Holtz | 5/441 |
| 4,394,783 | 7/1983 | Simmons | 5/436 |
| 4,397,052 | 8/1983 | Lund | 5/437 |

FOREIGN PATENT DOCUMENTS

| | | | |
|---|---|---|---|
| 483837 | 6/1952 | Canada | 5/437 |

*Primary Examiner*—Alexander Grosz

[57] ABSTRACT

A comfort enhancing assembly for providing abdominal and back support is formed of a first pillow and a second pillow which are connected by two overlapped flexible connector panels by a plurality of hook and loop type connector strips on each panel.

7 Claims, 6 Drawing Figures

COMFORT PILLOW FOR PREGNANT FEMALES

BACKGROUND OF THE INVENTION

The present invention is in the field of comfort enhancing items and is more specifically directed to a unique pillow assembly of particular benefit for enhancing the comfort of pregnant women and for aiding persons with back problems requiring a stabilized support of the body.

Women in the advanced stages of pregnancy frequently suffer from extreme discomfort and inability to sleep as a consequence of their condition. It has been found that the positioning of a pillow against the back and abdomen provides a certain amount of relief from the foregoing problems; however, it is extremely difficult to maintain loose pillows in such a position so that the relief is normally transitory. Similarly, persons suffering from a variety of back problems, such as pinched nerves, slipped discs, and the like also require a similar type of support in order to obtain comfort with the problems of maintaining the position of the pillows being generally the same as those encountered by pregnant women. It has been proposed in Canadian Patent No. 483,837 to provide two spaced pillows connected by a thinner intermediate pillow; however, the spacing between the outer pillows cannot be adjusted so that such a pillow must be specifically manufactured for a person of a particular size. Moreover, a pregnant women would require several such pillows during the course of a pregnancy as her size increases.

Spaced apart pillows connected by a reduced size intermediate member as well as other constructions have been suggested for alleviating the foregoing and other problems as shown or suggested in the know prior art which comprises U.S. Pat. Nos. 428,819; 716,752; 941,043; 2,765,480; 3,118,152; 3,763,509; and 3,775,785 and Canadian Patent No. 483,837. However, none of the prior art patents disclose a thin comfortable flexible pillow connection which has a smooth surface and is fully adjustable in an infinite number of positions.

Therefore, there has been an unmet need for a versatile pillow assembly capable of adjustment of for accommodating persons of different size.

It is consequently the primary object of the present invention to provide a new and improved therapeutic pillow assembly which is easy to use, adjustable, and trouble free.

SUMMARY OF THE INVENTION

Achievement of the foregoing object is enabled by the preferred embodiment of the invention which includes first and second pillow members of generally oval shaped configuration with each pillow member including a flexible connector panel extending from one side of the pillow member. Each flexible connector panel has three strips of Velcro connector material attached to one of its sides with the three strips on the panels being alignable with each other to permit the connector panels to be connected to each other. Since the Velcro connectors strips are of substantial length, the distance between the pillows can be infinitely adjusted to provide optimum comfort for a user. Additionally, each of the pillows includes a handle member attached to the side of the pillow opposite the side connected to the connector panel so as to permit easy carrying and storage of the pillow by hanging if desired.

A better understanding of the construction and use of the preferred embodiment will be obtained when the following detailed description is considered in conjunction with the appended drawings in which like reference numerals are used for the same parts as illustrated in the different drawing figures.

DESCRIPTION OF THE PREFERRED EMBODIMENT

Figure 2:
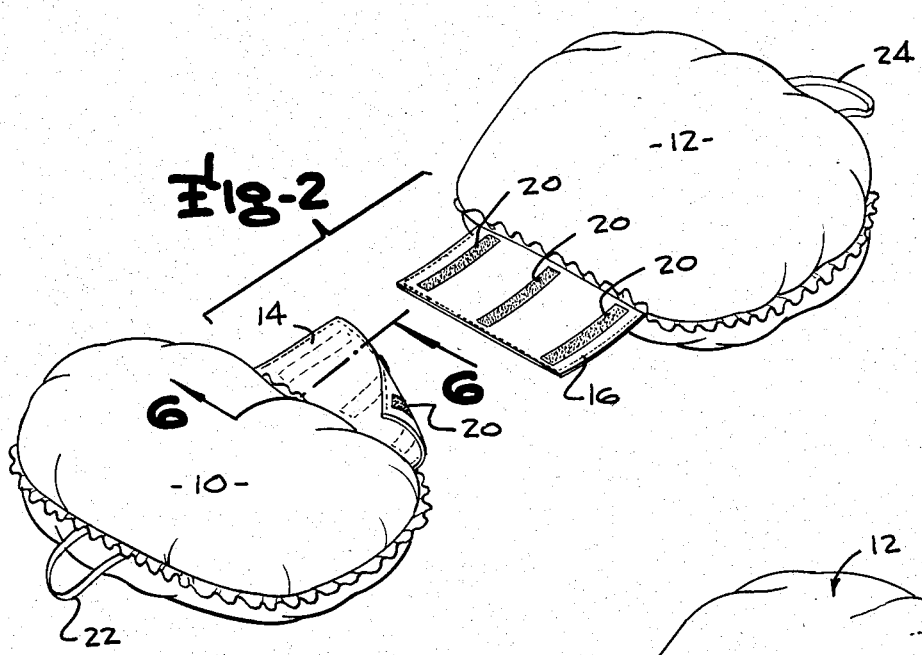
FIG. 2 is an exploded perspective view of the preferred embodiment illustrating the pillow components in separated condition.
Figure 3:
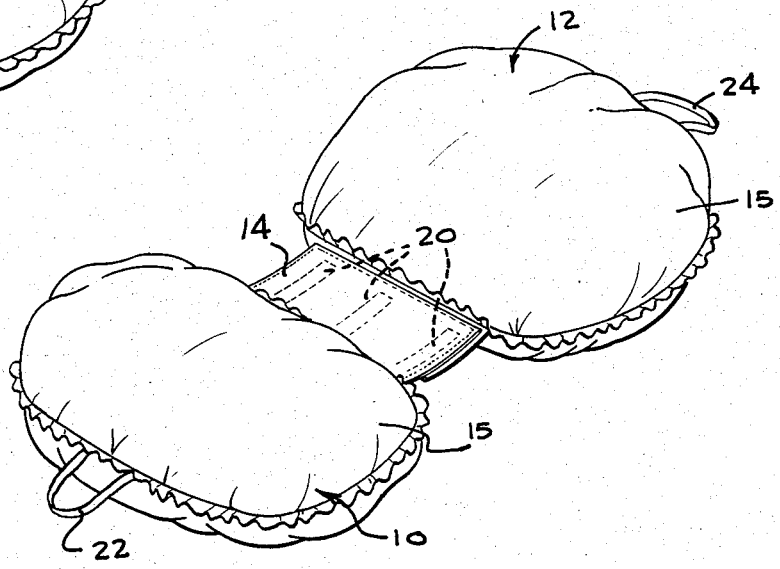
FIG. 3 is a perspective view similar to FIG. 2 but illustrating the components in assembled connected condition.

The preferred embodiment, as best shown in FIG. 2, comprises a first pillow 10 and a second pillow 12 of generally oval configuration and transverse cross-section each of which pillow is identical to the other. Pillows 10 and 12 are filled with foam or other similar conventional pillow stuffing material 13 which is held in position by cover member 15. A first connector panel 14 extends from one side of first pillow 10, midway its height and along a major portion of its length, and a second connector panel 16 similarly extends from the second pillow 12. Connector panel 14 includes a central stiffener panel constituent 18 formed of cloth, batting, or the like which maintains the connector panel in its desired shape but without a loss of flexibility. Each connector panel includes three parallel hook/loop (i.e., Velcro brand) connector strips 20 and outer fabric coverings 21 with the Velcro connector strips of one connector panel being alignable with the Velcro connector strips of the other connector panel.

Figure 4:
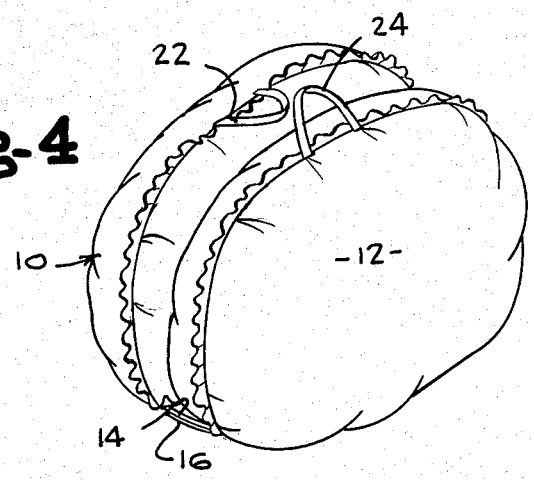
FIG. 4 is a perspective view illustrating the preferred embodiment in a folded carrying condition.
Figure 5:
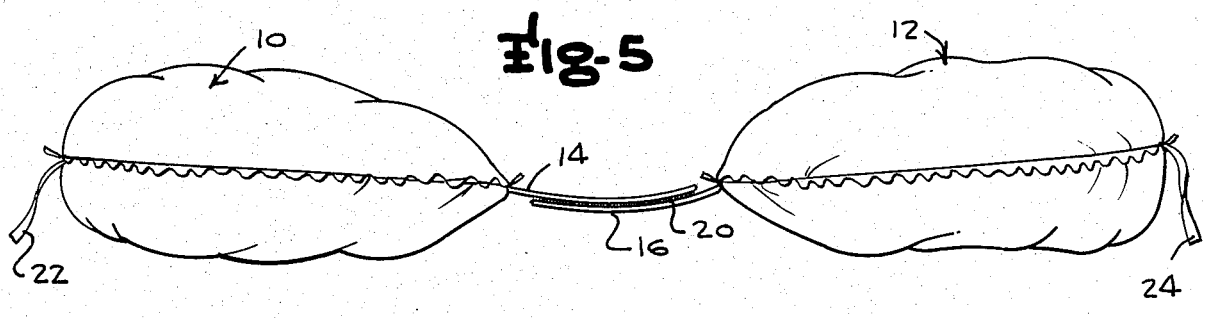
FIG. 5 is a front elevation view of the preferred embodiment.
Figure 6:
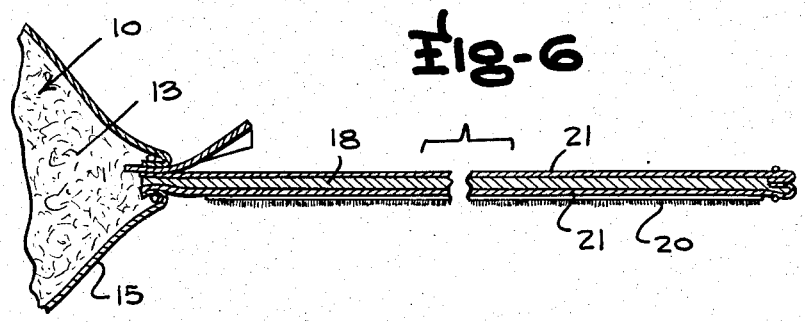
FIG. 6 is a bisecting sectional view illustrating the connector panel of one of the pillow components.

Additionally, pillow 10 includes a first handle 22 attached to its side opposite the side connected to the connector panel 14 whereas the second pillow member 12 includes a second handle 24 connected to its side opposite the connection to the second connector panel 16 as best shown in FIG. 2. The pillow assembly can be carried by folding it as shown in FIG. 4 so as to permit the grasping of handle members 22 and 24 in the hand of the user in an obvious manner.

Figure 1:
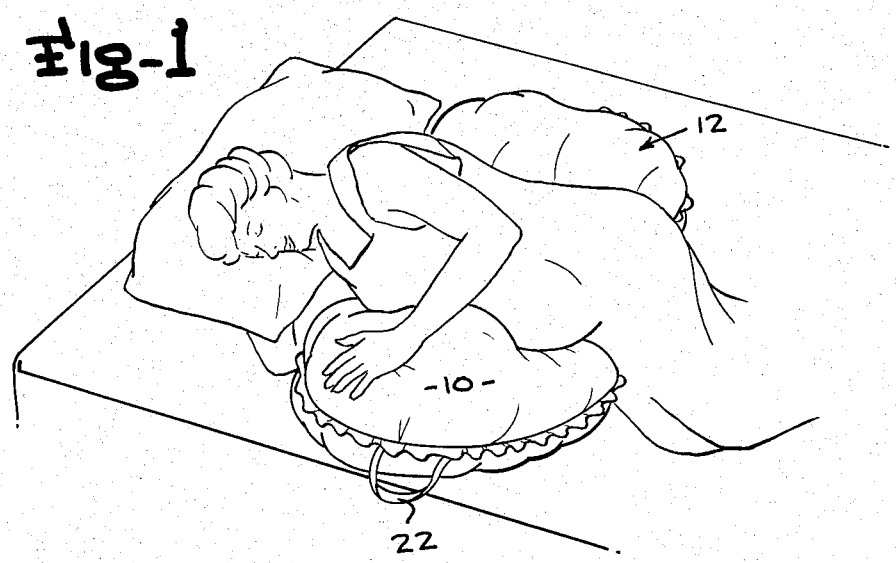
FIG. 1 is a perspective view illustrating usage of the preferred embodiment by a pregnant woman.

In use, one pillow is positioned against the abdomen of a user whereas the other pillow is positioned against the back of the user as shown in FIG. 1. This relationship provides both back and abdominal stabilization for the user and is extremely comfortable with the pillows being held in position by the connection between the Velcro strips 20. Moreover, the relatively thin and smooth nature of the connector panels 14 and 16 results in a flexible yet comfortable relationship with respect to the user. In fact, the weight of the user tends to pull the pillow members together toward the user so as to snugly sandwich the user between the pillow members. However, it should be appreciated that the distance between the pillow members can be easily adjusted as required by the size of the particular individual user.

Moreover, this adjustment is universal so as to permit obtainment of maximum comfort from the assembly.

Numerous modifications of the preferred embodiment will undoubtedly occur to those of skill in the art; however, it should be understood that the spirit and scope of the invention is to be limited solely by the appended claims.

We claim:

1. A comfort enhancing assembly sized for providing abdominal and back support for a pregnant female comprising a first pillow of generally oval configuration and a second pillow of generally oval configuration and transverse cross-section, a first flexible connector panel extending from one side of said first pillow generally midway the height of said first pillow, a second flexible connector panel extending from one side of said second pillow generally midway the height of said second pillow and being in overlapped relation with said first flexible connector panel, first handle means extending outwardly from the side of said first pillow opposite first connector panel, second handle means extending outwardly from the side of said second pillow opposite said second connector panel, and interengaging connecting means on one side of each of said connector panels, said connecting means on first connector panel being in position for engaging said interengaging connecting means on said second connector panel when said panels are in overlapping relationship with the sides thereof including said interengaging connecting means facing each other and permitting connection of said panels in a multiplicity of positions for obtaining a multiplicity of spacings between said pillows so as to provide optimum comfort for a user, each of said connector panels extending along the respective said one side of a said pillow for a major portion of the length of said one side and outwardly from the respective one of said pillows a sufficient distance to allow said first and second pillows to be spaced relatively close to each other when said panels are substantially overlapped and relatively far apart when said panels are only partially overlapped, each of said connector panels comprising a stiffener for maintaining the shape of the panel without loss of flexibility, and a fabric covering overlying each side of said stiffener, and the portions of said pillows facing each other when said connecting panels are connected together being substantial mirror images.

2. A comfort enhancing assembly as recited in claim 1 wherein said interengaging connection means comprises hook/loop connector strips, said strips on at least one of said connector panels extending generally perpendicular to the side of said pillow to which said connector panel is attached.

3. A comfort enhancing assembly as recited in claim 1 wherein said interengaging connection means respectively comprise three parallel hook and loop type connector strips.

4. The comfort enhancing assembly of claim 1 wherein the said interengaging means on each of said panels extends from adjacent said side of the said pillow to which said panel is attached to adjacent the far edge of said each panel.

5. The comfort enhancing assembly of claim 4 wherein the said interengaging means on one of said panels includes a plurality of parallel hook fastener strips.

6. The comfort enhancing assembly of claim 1 wherein the said interengaging means on one of said panels is arranged in a plurality of parallel lines each having one end thereof adjacent said one side of the said pillow to which said one panel is attached and the opposite end thereof adjacent the far edge of said one panel, and the said interengaging means on the other of said panels is arranged to engage each line of the interengaging means on said one of said panels at any of a multiplicity of positions between said ends thereof, thereby permitting said panels to be connected to each other so as to obtain said multiplicity of spacings between said pillows.

7. The comfort enhancing assembly of claim 1 wherein said first pillow and said first connector panel are substantially identical, respectively, to said second pillow and said second connector panel.

* * * * *